US009891591B2

(12) United States Patent
Di Domenico

(10) Patent No.: US 9,891,591 B2
(45) Date of Patent: Feb. 13, 2018

(54) MAGNETIC CLOCK ESCAPEMENT AND DEVICE FOR REGULATING THE OPERATION OF A CLOCK MOVEMENT

(71) Applicant: The Swatch Group Research and Development Ltd, Marin (CH)

(72) Inventor: Gianni Di Domenico, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/308,902

(22) PCT Filed: Sep. 4, 2015

(86) PCT No.: PCT/EP2015/070237
§ 371 (c)(1),
(2) Date: Nov. 4, 2016

(87) PCT Pub. No.: WO2016/037938
PCT Pub. Date: Mar. 17, 2016

(65) Prior Publication Data

US 2017/0068222 A1 Mar. 9, 2017

(30) Foreign Application Priority Data

Sep. 9, 2014 (EP) ..... 14184158
Sep. 19, 2014 (EP) ..... 14185638

(51) Int. Cl.
*G04B 15/14* (2006.01)
*G04C 5/00* (2006.01)

(52) U.S. Cl.
CPC ..... *G04C 5/005* (2013.01); *G04B 15/14* (2013.01)

(58) Field of Classification Search
CPC ..... G04C 3/022; G04C 3/024; G04C 5/005; G04C 5/00; G04B 15/08; G04B 15/14; G04B 17/06
See application file for complete search history.

(56) References Cited

U.S. PATENT DOCUMENTS 2,946,183 A * 7/1960 Clifford ..... G04C 5/005 368/126
9,292,002 B2 * 3/2016 Di Domenico ..... G04C 3/105
(Continued)

FOREIGN PATENT DOCUMENTS

FR 1113932 * 4/1956
FR 2.132.162 A1 11/1972
GB 1361672 * 3/1971

OTHER PUBLICATIONS

International Search Report dated Jan. 18, 2016 in PCT/EP2015/070237 filed Sep. 4, 2015.

*Primary Examiner* — Sean Kayes
(74) *Attorney, Agent, or Firm* — Oblon, McClelland, Maier & Neustadt, L.L.P.

(57) ABSTRACT

A magnetic clock escapement, and a regulating device, the escapement including a first circular network formed by N1 magnetic lines and a second circular network formed by N2 magnetic lines, N2 being different from N1. The first and second networks are superimposed to define a combined pattern having a magnetic Moiré effect. The combined pattern is coupled magnetically to at least one magnet of a resonator to pace operation of a mechanical clock movement. The first magnetic structure is carried by an escapement wheel and can rotate relative to the second fixed magnetic structure with an angular frequency F1. The combined pattern rotates with a greater angular frequency F2 and equal to the angular frequency F1 multiplied by the number
(Continued)

N1 and divided by the number ΔN equal to this number N1 minus the number N2, $F2=F1 \cdot N1/\Delta N$.

30 Claims, 9 Drawing Sheets

(56) References Cited

U.S. PATENT DOCUMENTS

| | | | | |
|---|---|---|---|---|
| 9,465,366 | B2 * | 10/2016 | Di Domenico | G04B 17/32 |
| 2016/0357155 | A1 * | 12/2016 | Di Domenico | G04C 5/005 |

* cited by examiner

MAGNETIC CLOCK ESCAPEMENT AND DEVICE FOR REGULATING THE OPERATION OF A CLOCK MOVEMENT

TECHNICAL FIELD

The present invention relates to the field of devices for regulating the operation of a clock movement. In particular, the present invention relates to clock escapements of the magnetic type, the normal functions of which are maintenance of a resonance mode of a resonator, in particular a continuous oscillation or rotation of an inertial part of this resonator, and the pace of a counting mechanism. Within the scope of the present invention, the magnetic escapement ensures these two functions by means of an escapement wheel comprising a magnetic structure which is coupled magnetically to at least one magnet carried by a part of the resonator subject to the resonance movement.

TECHNOLOGICAL BACKGROUND

The devices for regulating the speed of a wheel, also termed rotor, by a magnetic coupling, also termed magnetic link, have been known for many years. The clock application is also known. Numerous patent applications relating to this field have been filed by the company Horstmann Clifford Magnetics for the inventions of C. F. Clifford. In particular documents FR 1,113,932 and U.S. Pat. No. 2,946,183 will be cited. There is also known from the Japanese utility model JPS 5263453U (application No. JP19750149018U), a magnetic escapement of the same type with a direct magnetic coupling between a resonator and an escapement wheel formed by a disc supporting two coaxial annular magnetic tracks. These two tracks are substantially contiguous and each comprise magnetic zones formed by individual plates made of high-permeability magnetic material which are designed regularly with a given angular period, the plates of the first track being offset or phase-shifted by a half-period relative to the plates of the second track. Between the plates, non-magnetic zones are provided, i.e. zones with poor magnetic permeability. Thus high-permeability magnetic zones distributed alternately on both sides of a circle corresponding to the rest position (zero position) of at least one magnet carried by the end of a branch of a resonator of the tuning fork type are obtained. The magnet of the resonator is coupled magnetically to these two phase-shifted tracks such that it is attracted alternately by the magnetic zones of the first track and of the second track. The escapement wheel thus rotates with a speed of rotation such that it advances by one angular period of the two tracks at each oscillation of the resonator. The escapement wheel provides the energy necessary to maintain the oscillation of the branch of the resonator carrying the magnet of the magnetic coupling and this resonator controls or regulates the speed of rotation of this escapement wheel, which is proportional to the resonance frequency. There is thus a magnetic escapement connected to a resonator which together form a device for regulating the operation of a counting mechanism of a clock movement.

It will be noted that regulating devices of the previously mentioned magnetic type are provided in prior art for resonators which have a single degree of freedom for each part subject to a resonance movement. In general, the resonator is designed such that the magnet, carried by an element subject to a resonance movement, oscillates according to a substantially radial direction, i.e. substantially orthogonal to the two annular magnetic tracks. In this case, the mentioned embodiments of the prior art have the advantage of having a frequency reduction between the frequency of the oscillation of the resonator and the rotation frequency (in revolution/s) of the escapement wheel carrying the magnetic structure. No pivoted moving body rotates or oscillates at a frequency of the order of magnitude of the resonance frequency. The reduction factor is given by the number of angular periods of the annular magnetic tracks.

In the case of these resonators with a single degree of freedom, the above-mentioned advantage, following a frequency reduction between the oscillation of the resonator and the rotation of the escapement wheel, has a corollary which presents a problem for the magnetic coupling force. In fact, in order to increase the frequency reduction, it is necessary to increase the number of periods of the magnetic tracks. For a given diameter of the escapement wheel, an increase in the number of periods results in a decrease in the surface of the magnetic zones of the annular tracks. As the magnet of the resonator extends over an angular distance less than a half-period of the annular tracks, the dimensions of this magnet must also decrease when the frequency reduction increases. It is therefore understood that the magnetic interaction force between the resonator and the escapement wheel decreases; which limits the torque which can be applied to the escapement wheel and therefore increases the risk of loss of synchronisation between this resonator and this escapement wheel. There is understood here by synchronisation, a determined proportional relationship between the resonance frequency and the frequency of rotation of the escapement wheel.

Finally, it will be noted that clock regulating devices of the magnetic type comprising a resonator with two degrees of freedom, in particular a resonator, the inertial part of which has a trajectory in translation substantially describing a circle, by rotating continuously in the same direction, are not known. A requirement to design escapements of the magnetic type for such resonators with two degrees of freedom, with a decrease in the level of magnetic coupling, does however exist in the field of timepieces. This requirement even seems crucial when the resonator functions at a relatively high resonance frequency, for example resonators, the resonating element of which rotates at a frequency greater than ten revolutions per second (10 revolution/s=10 Hz). In fact, a mechanical coupling which would consist of connecting such a resonating element to a moving body would result in setting this moving body in rotation at the resonance frequency. A pivoted moving body with a rotation frequency greater than five or six revolutions per second poses a major problem of loss of energy by friction and a problem of wear and tear at the level of the bearings.

SUMMARY OF THE INVENTION

The object of the present invention is to meet the identified requirements in the field of clock regulating devices, in particular for resonators with two degrees of freedom with a circular resonance movement, and to find a solution to the problem associated with the week magnetic interaction in the case of resonators with a single degree of freedom connected to a known magnetic escapement which has a great frequency decrease.

To this end, the subject of the present invention is a magnetic escapement equipping a mechanical clock movement and comprising an escapement wheel driven by a motor device and coupled to a resonator of this mechanical clock movement, this escapement wheel comprising a first magnetic structure defining, within a non-zero radial range of this escapement wheel, a first periodic pattern with a first angular period P1 such that 360°/P1 is equal to a first whole number N1, the magnetic escapement comprising at least one magnet mounted on the resonator and coupled magnetically to the escapement wheel such that, when the mechanical clock movement functions, this magnet has a periodic resonance movement at a resonance frequency and such that the escapement wheel rotates with a frequency proportional to this resonance frequency. The magnetic escapement comprises in addition a second magnetic structure parallel to the first magnetic structure and defining, within said radial range, a second periodic pattern having a second angular period P2 such that 360°/P2 is equal to a second whole number N2 which is different from the whole number N1, the difference in absolute value |ΔN| between the numbers N1 and N2 being a number less than or equal to N/2, i.e. |ΔN|<=N/2, N being the lower number of the numbers N1 and N2. The first and second magnetic structures are designed such that, when the clock movement functions, the first magnetic structure has a rotation relative to the second magnetic structure at a first relative angular frequency $F1_{rel}$. The first periodic pattern and the second periodic pattern are selected such that they generate, within said radial range, in projection on a geometric surface parallel to the first and second magnetic structures, a combined pattern coupled to said magnet and defining, alternately, at least the number |ΔN| of first zone(s) with a first proportion of magnetic surface and at least this number |ΔN| of second zone(s) with a second proportion of magnetic surface less than the first proportion, and such that the combined pattern rotates relative to the second magnetic structure with a second relative angular frequency $F2_{rel}$ equal to the first relative angular frequency $F1_{rel}$ multiplied by the number N1 and divided by the difference ΔN between the numbers N1 and N2, i.e. $F2_{rel}=P1_{rel}\cdot N1/\Delta N$ where ΔN=N1−N2.

There is understood by angular frequency, the number of revolutions per second, corresponding to the inverse of the temporal period of the periodic movement.

In a preferred variant, the magnet has an axis of magnetisation perpendicular to the geometric surface of said combined pattern.

In a preferred embodiment, the combined pattern defines a periodic combined pattern which has, alternately, the number |ΔN| of first zone(s) and this number |ΔN| of second zone(s), any first zone and an adjacent second zone defining an angular period P3 of this periodic combined pattern, the value of which is equal to 360° divided by the number |ΔN|, i.e. P3=360°/|ΔN|.

In an improved embodiment, the magnetic escapement according to the invention comprises a second magnet mounted on the resonator and supported by said resonant part or by another resonant part of the resonator. This second magnet is designed relative to the first magnet on the other side of the first and second magnetic structures such that it is aligned with the first magnet in a direction substantially parallel to the axis of rotation and such that it has a periodic resonance movement similar to that of the first magnet at the resonance frequency.

In a first variant, the second magnet has an axis of magnetisation parallel to that of the first magnet and in the opposite direction. In a second variant, the second magnet has an axis of magnetisation parallel to that of the first magnet and in the same direction.

In an advantageous variant of the improved embodiment, the magnetic escapement comprises a third magnetic structure defining a periodic pattern substantially identical to the periodic pattern defined by the first or second magnetic structure and superimposed on the latter, this third periodic structure being integral in rotation with this first or second magnetic structure, in the case where the latter is subject to a rotation. The two magnetic structures having the same periodic pattern are situated respectively on both sides of the magnetic structure having a different periodic pattern.

In an advantageous variant, the second magnetic structure is fixed relative to the clock movement, the first relative angular frequency $F1_1$ defining the angular frequency of the escapement wheel relative to this clock movement.

The present invention relates likewise to a first device for regulating the operation of a clock movement comprising a magnetic escapement according to the intention and a resonator, one resonant part of which supporting said magnet is subject, during functioning of the clock movement, to an oscillation according to one degree of freedom. The resonator is designed such that the centre of the magnet in its rest position is substantially situated, for any angular position of the escapement wheel, on a zero position circle which is centred on the axis of rotation of the escapement wheel and which is traversed by the degree of freedom of the resonant part of the resonator. The periodic combined pattern defined by the magnetic escapement is situated on a first side of the zero position circle, projected perpendicularly in the geometric surface, the annular region of the first and second magnetic structures, defined by said radial range, being coupled magnetically to the magnet in a first alternation of each period of said oscillation such that, for each period of this oscillation, the periodic combined pattern rotates by an angular distance equal to its angular period P3.

In a preferred embodiment of the first regulating device, the periodic combined pattern is a first periodic combined pattern and the radial range is a first radial range, the first and second magnetic structures defining respectively, within a second non-zero radial range of the escapement situated on the other side of the zero position circle, relative to the first radial range, a third periodic pattern and a fourth periodic pattern which generate a second periodic combined pattern, having, alternately, the number |ΔN| of third zone(s), with a third proportion of magnetic surface greater than said second proportion, and this number |ΔN| of fourth zone(s), with a fourth proportion of magnetic surface which is less than the first and third proportions, this second periodic combined pattern having said angular period P3. The second periodic combined pattern is offset angularly by half an angular period P3 relative to the first periodic combined pattern, this second periodic combined pattern rotating likewise with the relative angular frequency $F2_{rel}$ of the first periodic combined pattern, the annular region of the first and second magnetic structures, defined by the second radial range, being coupled magnetically to the magnet in a second alternation of each period of said oscillation.

In a particular variant, the first and second periodic combined patterns are substantially contiguous.

The present invention likewise relates to a second device for regulating the operation of a clock movement comprising a magnetic escapement according to the invention and a resonator having a resonant part supporting said magnet, this resonator being designed such that this resonant part is subject to a radial return force relative to the axis of rotation of the escapement wheel when the centre of the magnet is moved away from this axis of rotation, and such that the centre of this magnet substantially describes a circle, centred on said axis of rotation, at an angular resonance frequency when it is moved away from this axis of rotation and such that this magnet is set in rotation with a substantially constant torque. The annular region of the first and second magnetic structures, defined by said radial range, is coupled magnetically to the magnet such that this magnet is set in rotation by a magnetic interaction torque resulting from the combined pattern rotating when a driving torque, within a useful range of the driving torque, is provided for the escapement wheel, the angular frequency of the combined pattern being controlled at the angular resonance frequency within this useful range of the torque, which is selected such that the magnetic interaction torque remains lower than a maximum magnetic interaction torque and such that the circle described by the centre of the magnet has a radius within the radial range for any driving torque of this useful range.

In a preferred variant, the resonator is designed and the useful range of the driving torque is selected such that the magnet is entirely superimposed on the combined pattern for any driving torque of this useful range.

Other particular features of the invention will be explained hereafter in the detailed description of the invention.

BRIEF DESCRIPTION OF THE DRAWINGS

The invention will be described hereafter with the help of annexed drawings, given by way of example in a non-limiting manner, in which.

DETAILED DESCRIPTION OF THE INVENTION

Figure 1:
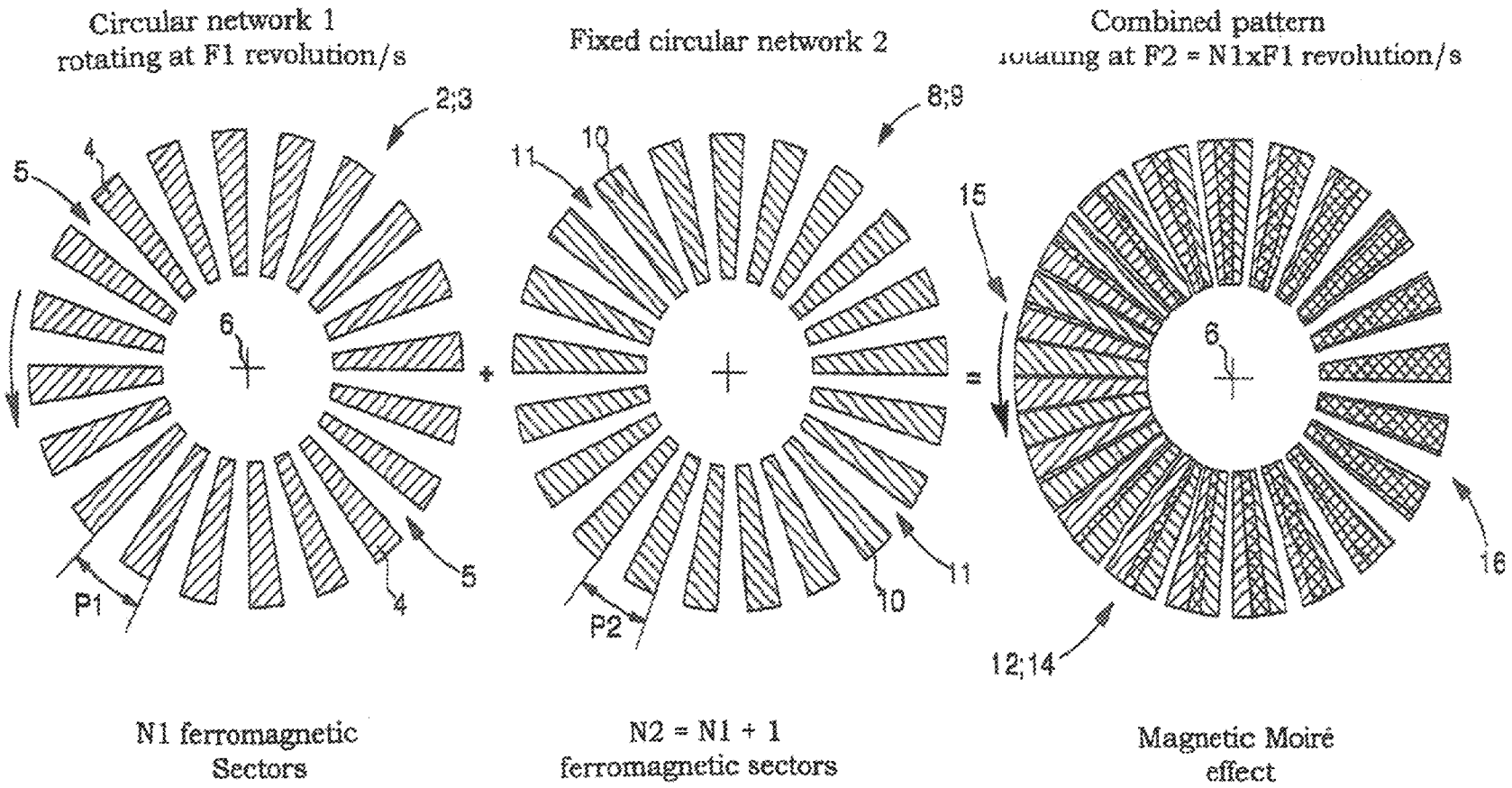
FIG. 1 represents schematically, in plan view, two magnetic structures occurring in a first embodiment of a magnetic escapement according to the invention and their superimposition in order to form this first embodiment.

In FIG. 1, there is shown, in part, the construction of a first embodiment of a magnetic escapement 12 equipping a mechanical clock movement and comprising an escapement wheel formed from a first magnetic structure 2 which defines, in an annular surface, a first circular network 3 having a first whole number N1 (N1=20 in the represented example) of lines 4 made of magnetic material, separated by lines 5 defined by a space or a substantially non-magnetic material. This first circular network has thus a first angular period P1 equal to 360°/N1. The magnetic escapement 12 comprises furthermore a second magnetic structure 8 which defines a second circular network 9 having a second whole number N2, different from the number N1, (N2=21 in the represented example) of lines 10 made of magnetic material, separated by lines 11 defined by a space or a substantially non-magnetic material. This second circular network has thus a second angular period P2 equal to 360°/N2. In the particular variant which is represented, the lines 4 extend substantially over half of the first angular period P1 and the lines 10 extend substantially over half of the second angular period P2. There is understood by magnetic material, a material with high magnetic permeability, in particular a ferromagnetic material.

The difference in absolute value $|\Delta N|$ between the numbers N1 and N2 is here equal to one ($|\Delta N|=1$). In general, it is provided that the difference in absolute value $|\Delta N|$ between the numbers N1 and N2 is less than or equal to N/2, i.e. $|\Delta N|<=N/2$, N being the lower number of the numbers N1 and N2. In a preferred variant, it is provided that the number $|\Delta N|$ is less than or equal to N/3, i.e. $|\Delta N|<=N3$.

The first and second circular networks are mounted in a parallel manner at a relatively small spacing from each other. They are designed such that, when the clock movement functions, the first network has a rotation relative to the second network, about the axis of rotation 6 of the escapement wheel, at a first angular frequency F1. In the given example, the second magnetic structure is fixed relative to the clock movement such that the frequency F1 is that of the first circular network in the clock movement (defining a fixed reference). The first and second circular networks generate, in an annular surface (having thus a non-zero radial range), in projection in a geometric plane parallel to these circular networks, a combined pattern 14 defining a first zone 15 with a large proportion of magnetic surface and a second zone 16 with a lesser proportion of magnetic surface. The combined pattern 14 is coupled magnetically to a magnet of the resonator (not represented). What is notable is that the combined pattern 14 rotates with a second angular frequency F2 which is, in absolute value, N1 times greater than the first angular frequency F1 for the particular case of the given example where the number $|\Delta N|=1$. Thus, with a first circular network 3 having twenty lines, as represented in FIG. 1, the combined pattern rotates twenty times faster than this network 3. It will be noted that the density of magnetic surface in the combined pattern varies substantially linearly between 50% and 100%. There is understood by proportion of magnetic surface, the ratio between the surfaces defined by the magnetic material of the first and second circular networks in a given zone of the combined pattern and the total surface of this zone.

Analogously to the optical Moiré effect, generation of the combined pattern with zones having various proportions of magnetic surface is considered here as a magnetic Moiré effect. In general, by providing a difference in lines |ΔN| between the two networks, |ΔN| being the difference in absolute value between the number N1 and the number N2, there is obtained, alternately, a number |ΔN| of first zone(s) with a first proportion of magnetic surface and a number |ΔN| of second zone(s) with a second proportion of magnetic surface which is less than the first proportion. The combined pattern rotates with a second angular frequency F2 equal to the first angular frequency F1 multiplied by the number N1 and divided by the difference ΔN=N1−N2, i.e. F2=F1·N1/ΔN. Within the scope of the present invention, the first magnetic structure forms an escapement wheel. It will be noted that the number ΔN can be positive or negative. In the case where it is positive, the combined pattern rotates in the same direction as the escapement wheel. In the case where the number ΔN is negative, the combined pattern rotates in the opposite direction to that of the escapement wheel; which corresponds mathematically to a negative frequency. The magnetic escapement 12 again comprises at least one magnet fixed to the resonator and coupled to the first and second circular networks, as will be explained subsequently.

Figure 2:
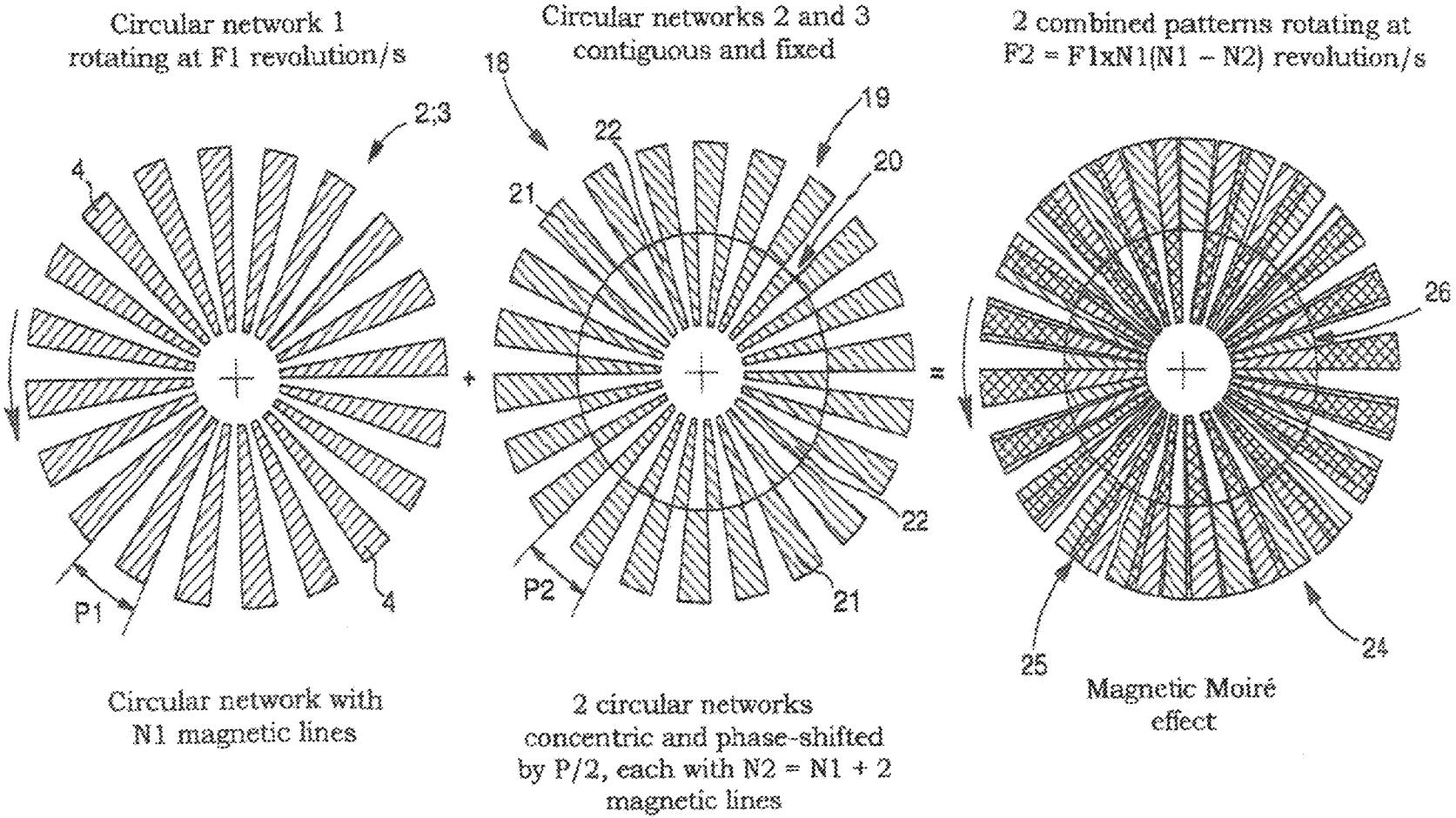
FIG. 2 represents schematically, in plan view, two magnetic structures occurring in a second embodiment of a magnetic escapement according to the invention and their superimposition in order to form this second embodiment.

In FIG. 2, a magnetic escapement 24 according to a second embodiment is represented in part. The first circular network 3 is similar to that of FIG. 1, but it extends over a greater radial distance. The second magnetic structure 18 forms two concentric circular networks 19 and 20 which extend into the respective contiguous annular surfaces. These two networks have the same number N2 of magnetic lines 21 and 22, separated by lines defined by a space or a substantially non-magnetic material, and have thus the same period P2. They are offset angularly by a half-period P2/2 and thus have a phase shift of 180°. In this example, N2=N1+2. By superimposing the two magnetic structures 2 and 18, there is obtained, in projection in a parallel geometric plane, a first combined pattern 25 which extends into an exterior annular surface and a second combined pattern 26 which extends into an interior annular surface. These two combined patterns are contiguous and rotate together at the second angular frequency F2, i.e. F2=(F1·N1)/(−2). As the number |ΔN|=2, each combined pattern has, alternately, two zones with a high proportion of magnetic surface and two zones with a lower proportion of magnetic surface.

Given the phase shift between the circular networks 19 and 20, the two combined patterns 25 and 26 likewise have a phase shift of 180°. In general, the alternation of zones with a high proportion of magnetic surface and zones with a lesser proportion of magnetic surface defines a periodic combined pattern having an angular period P3, the value of which is equal to 360° divided by the absolute value of the difference |ΔN| between the numbers N1 and N2, i.e. P3=360°/|ΔN|. In the example of FIG. 2, the two combined patterns 25 and 26 each have a period P3=360°/2=180°. It will be noted that the embodiment of FIG. 2 is a particular case with a single circular network on the escapement wheel which extends into an annular surface corresponding to the two concentric annular surfaces of the two circular networks of the second magnetic structure. In a variant, the first magnetic structure also comprises two separate circular networks, of the same period P1. For example, these two circular networks have an angular offset of P1/4 and the two circular networks of the second magnetic structure have an angular offset of P2/4. It will be noted again that, in one variant, the two circular networks of the first magnetic structure have different periods P1 and P2 and likewise those of the second magnetic structure, by reversing the periods P1 and P2 between the two magnetic structures.

Figure 3A:
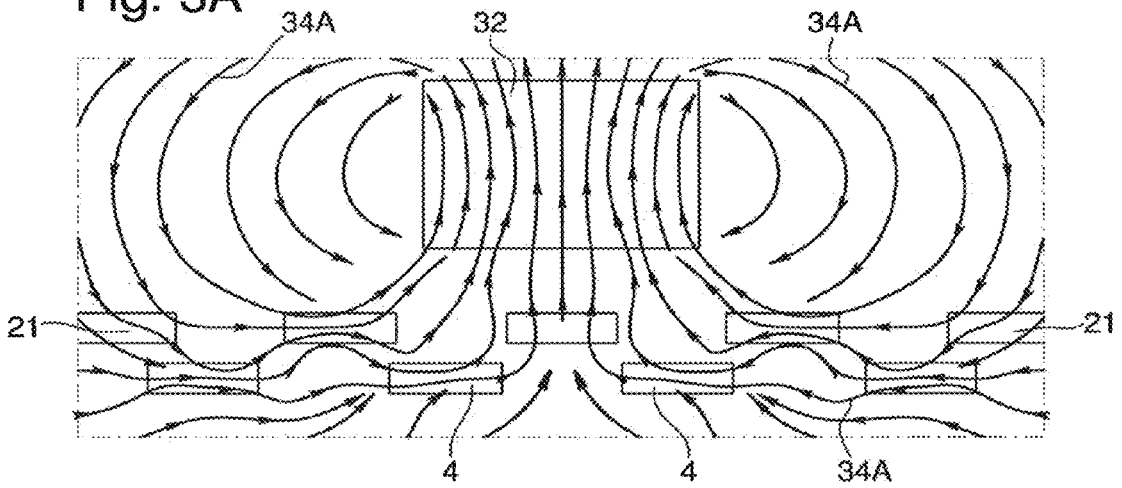
FIGS. 3A and 3B show, in partial section, a magnetic escapement according to the invention, respectively in a first position of a magnet of this magnetic escapement and in a second position of this magnet.
Figure 3B:
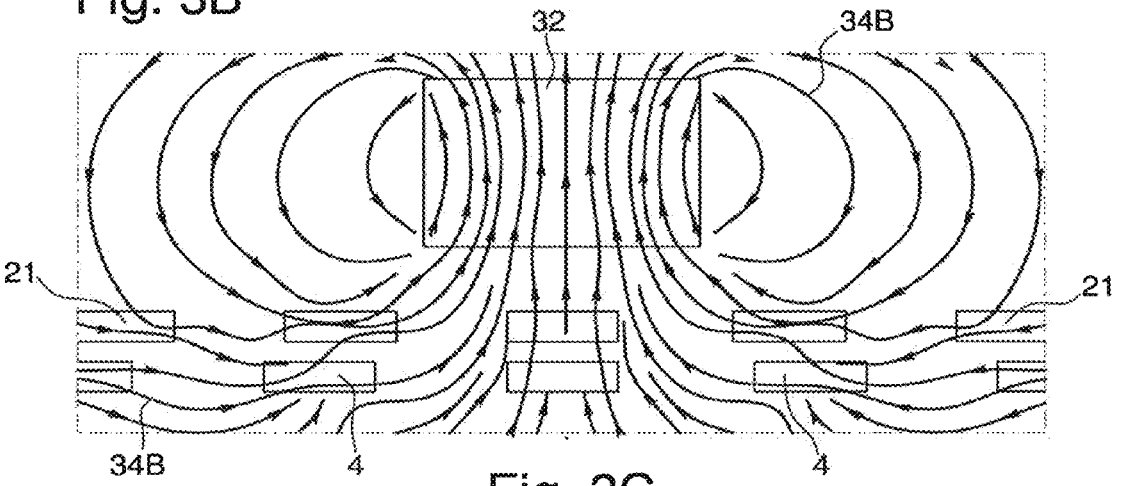
Figure 3C:
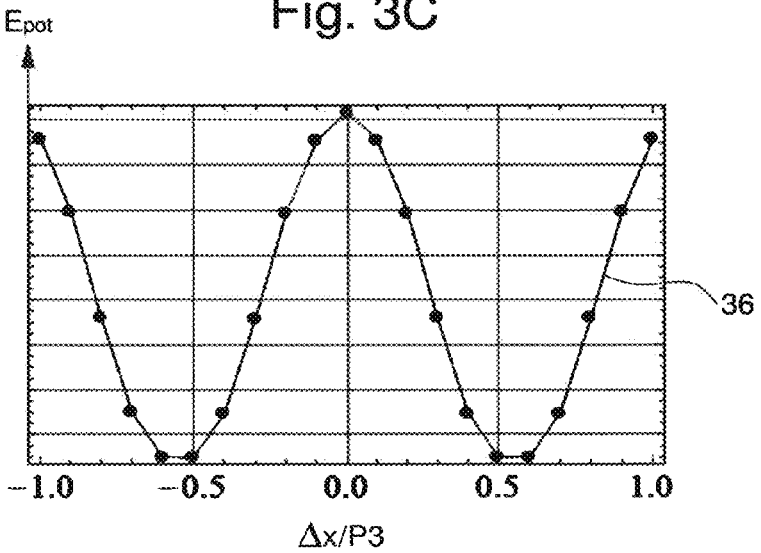
FIG. 3C shows a schematic graph of the magnetic potential energy variation of the magnetic escapement represented in FIGS. 3A and 3B.

As shown in FIGS. 3A and 3B, the magnetic escapement 24 comprises at least one magnet 32 mounted on the resonator and coupled magnetically to the two magnetic structures which are superimposed such that, when the mechanical clock movement functions, this magnet has a periodic resonance movement at a resonance frequency. According to the invention, the magnet, in magnetic interaction with the two magnetic structures, is subject to a movement which is connected to the resulting combined pattern, which is able to rotate much faster than the escapement wheel. In FIGS. 3A and 3B, there is represented, partially in section, the magnetic interaction of a magnet 32 with the two circular networks 3 and 19 of FIG. 2. The magnet has a magnetisation axis perpendicular to the geometric surface of the combined pattern. In FIG. 3A, the magnet is situated above a first zone of the combined pattern having a large proportion of magnetic surface. In this first zone, the two networks are offset angularly such that together they form a relatively continuous magnetic path for the field lines 34A of the magnet; the result of which is to reduce the magnetic reluctance for the magnet. In FIG. 3B, the magnet is situated above a second zone of the combined pattern having a lesser proportion of magnetic surface. In this second zone, the two networks are substantially superimposed such that the magnetic path for the magnet in these networks is interrupted by the empty spaces or formed by a non-magnetic material provided between the magnetic lines. It is understood that the field lines 34B of the magnet at the level of the two networks must pass through the empty spaces or non-magnetic regions. The magnetic reluctance is therefore increased relative to the situation of FIG. 3A. The result of this variation in magnetic reluctance is a variation in the magnetic potential energy $E_{pot}$ which is shown by the graph 36 in FIG. 3C. This variation in magnetic potential energy $E_{pot}$ causes a force on the magnet making it possible to set it in rotation and/or to maintain a resonance movement using two concentric annular magnetic tracks.

Figure 4:
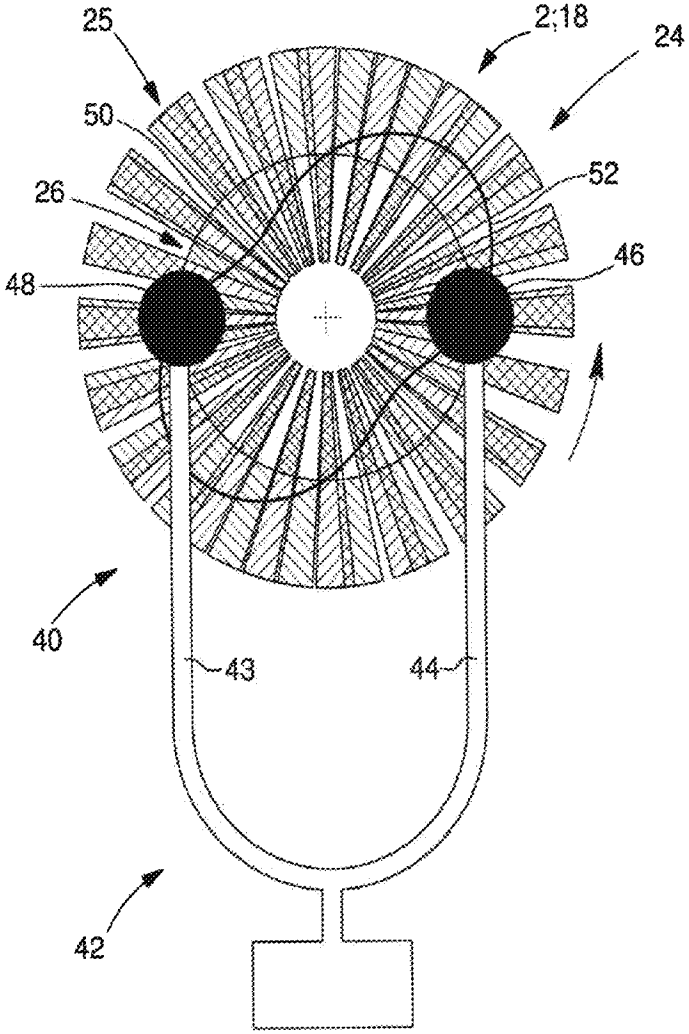
FIG. 4 represents schematically a first embodiment of a first regulating device according to the invention.

In FIG. 4, a first embodiment of a regulating device 40 according to a first type is represented. This regulating device comprises a magnetic escapement 24, as described in FIG. 2. The two superimposed magnetic structures 2 and 18 cause two periodic combined patterns 25 and 26, phase-shifted by 180°, as indicated previously. The resonator 42 is formed by a tuning fork with two branches 43 and 44. At the free ends of these two branches, two magnets 46 and 48 with an axial magnetisation are respectively fixed. In their rest position, the centres of the two magnets are situated over a circle 50, defining a zero position circle. This circle 50 is chosen such that it is merged with the circle separating the two contiguous combined patterns. Similarly to the devices mentioned in the technological background, the two combined patterns form two magnetic tracks with a periodic variation of potential energy of the oscillator, formed by the tuning fork 42 and the magnetic escapement. Each magnet oscillates according to one substantially radial degree of freedom. It is attracted alternately by the zones of low magnetic reluctance of the two magnetic tracks. Above each track, the magnets accumulate magnetic potential energy and brake the escapement wheel. By crossing the zero position circle, they each receive a pulse serving to maintain the resonance, given that they experience a jump of magnetic potential thanks to the angular offset of the two periodic combined patterns 25 and 26. Thus, in a rotating reference frame connected to the escapement wheel, the magnets follow a trajectory 50 corresponding to an oscillation according to the degree of freedom of each magnet.

Concerning the ratio of reduction between the oscillation frequency $F_{osc}$ of the tuning fork and the frequency of rotation F1 of the escapement wheel carrying the first magnetic structure (in the case where the second magnetic structure does not rotate), there is, on the one hand, the frequency of rotation F2 of the combined patterns 25 and 26 which is equal to $F1 \cdot N1/\Delta N$ ($\Delta N$ being the difference between N1 and N2). On the other hand, the oscillation frequency $F_{osc}$ is equal to $F2 \cdot \Delta N$. A relationship $F_{osc}=F2 \cdot \Delta N=F1 \cdot N1$, whatever $\Delta N$ is, is obtained. Thus, the reduction ratio is independent of the number $\Delta N$. An advantage can be drawn from this fact by selecting $\Delta N$ to be small, in particular $|\Delta N|=2$ or 4. The invention is notable because there can be periodic combined patterns with a relatively large period for a large ratio of reduction, and it is possible thus to use magnets of large dimensions having a relatively large magnetic interaction zone with the magnetic structures defining the combined patterns, without requiring a reduction in the reduction ratio. In order that the magnets of the tuning fork oscillate symmetrically relative to the axis of rotation 6, the number $\Delta N$ is an even number. In FIG. 4, $\Delta N=-2$.

Figure 5:
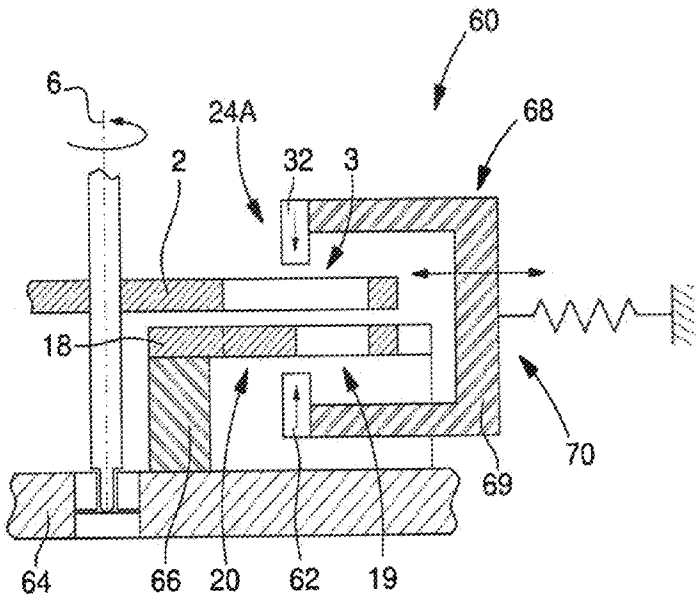
FIG. 5 represents schematically, in section, a second embodiment of the first regulating device according to the invention.

In FIG. 5, a second embodiment of a regulating device 60 according to the invention is represented, comprising a magnetic escapement 24A formed by a first magnetic structure 2 defining the first circular network 3, this structure 2 being mounted on a shaft and rotating about an axis of rotation 6. Furthermore, the magnetic escapement is formed by a second magnetic structure 18 defining two phase-shifted circular networks, as explained above with reference to FIGS. 2 and 4. This second embodiment is distinguished from the preceding one by the fact that the resonant part 68 of the resonator 70 comprises two magnets 32 and 62 provided respectively on both sides of the two magnetic structures and forming the magnetic escapement 24A. Such a configuration solves a problem of the first embodiment by the fact that, in so far as the two magnetic structures are situated substantially at equal distance from the respective magnets which are opposite them, the axial attraction forces on the two magnets by the magnetic structures compensate mutually for the most part. The same applies for the attraction forces exerted by the two magnets on the entirety of the two magnetic structures.

The two magnets are fixed to the ends of a non-magnetic element in the shape of a U. The resonator is represented with a schematic spring. The resonant part 68 can be fixed for example to a free end of a tuning fork. The functioning is similar to that of the first embodiment. Each magnet is coupled magnetically to the circular networks in the previously explained manner. They are aligned axially so as to be both perpendicular to the zero position circle. The structure 18 is fixed and supported by a disc 66 formed of a non-magnetic material. A lateral recess is provided in this disc so as to allow the resonant part 68 to pass under the structure 18. It will be noted that, in the shown variant, the magnetic structures 2 and 18 each have an interior annular part and an exterior annular part which connect the lines of the circular networks 3, 19 and 20.

Figure 6:
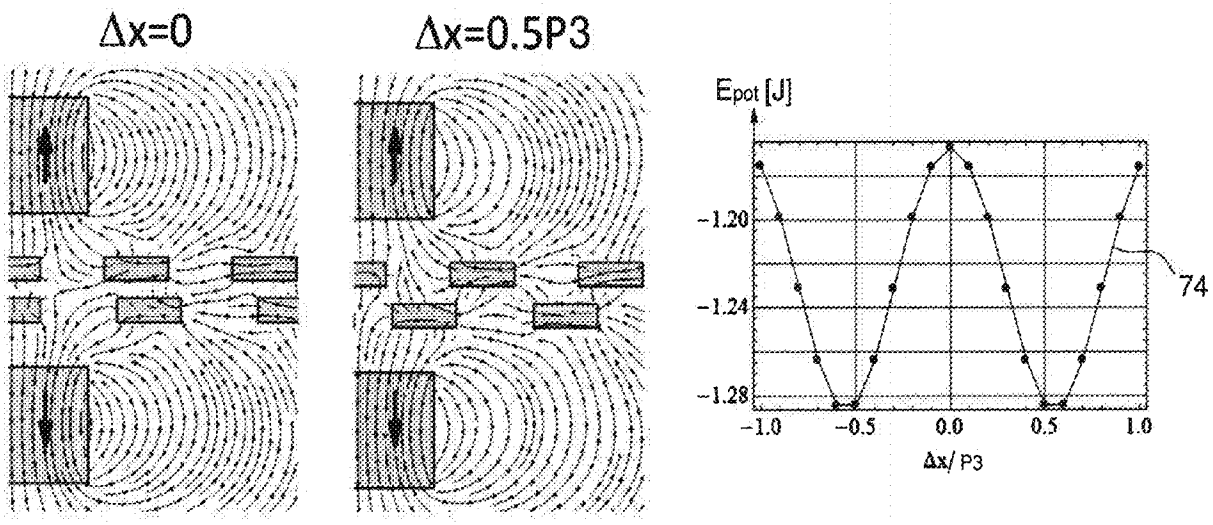
FIG. 6 shows two partial sections and a graph, respectively similar to those of FIGS. 3A, 3B and 3C, relative to a third embodiment of a magnetic escapement according to the invention.

In the represented variant, the two magnets have an axial magnetisation in opposite directions. This configuration is advantageous because it makes it possible to amplify the magnetic interaction as can be seen in FIG. 6. The first image ($\Delta x=0$) is a section similar to that of FIG. 3B whilst the second image ($\Delta x=0.5 \cdot P3$) is a section similar to that of FIG. 3A. In the second image, as the two superimposed circular networks substantially form a screen between the two magnets, the magnetic interaction is at a first approximation approximately equal to twice that for the case of a single magnet. In contrast, in the first image, the two magnets repel each other in the empty spaces between the magnetic lines. This repulsion force increases the magnetic potential energy $E_{pot}$. The curve 74 of $E_{pot}$ has a profile similar to that of the curve 36 of 3C. However, a computer simulation has made it possible to establish that the amplitude of the periodic curve 74 is a priori of an order of magnitude greater than the amplitude of the periodic curve 36.

Figure 7:
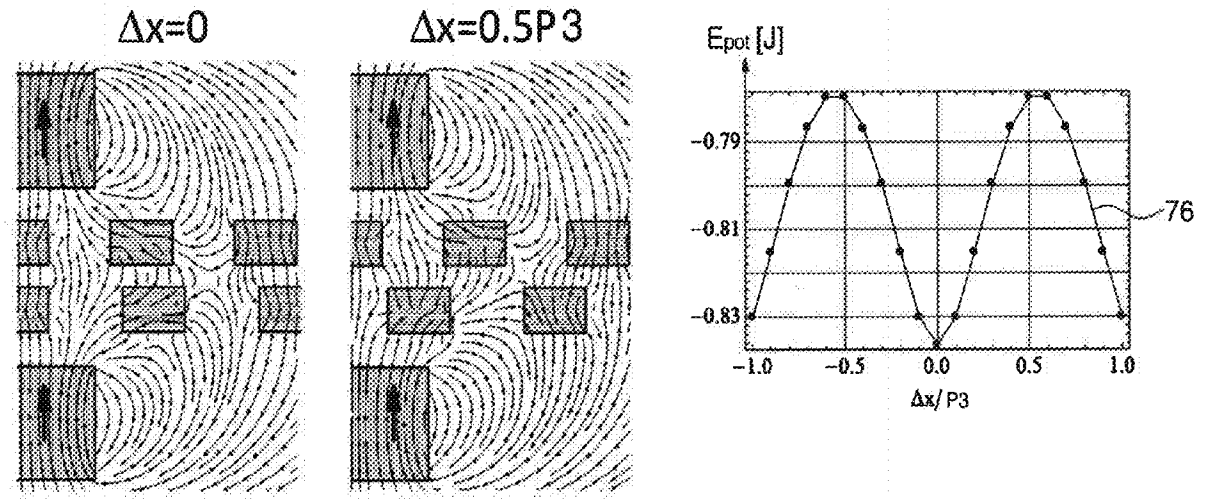
FIG. 7 shows two partial sections and a graph, respectively similar to those of FIGS. 3A, 3B and 3C, relative to a fourth embodiment of a magnetic escapement according to the invention.

In a variant represented in FIG. 7, the two magnets have an axial magnetisation in the same direction. The lines of the circular networks are provided here to be thicker. It can be seen on the graph of the magnetic potential energy that the curve 76 of $E_{pot}$ is the inverse of the curve 74. In fact, given that in this variant the magnetic flux between the two magnets is substantially channeled axially, a zone of greater proportion of magnetic surface of a combined pattern has a greater magnetic reluctance for the two magnets than in the case where they are opposite a zone of lesser proportion of magnetic surface. The amplitude of the periodic curve 76 is a priori in the represented configuration approximately half of that of the periodic curve 74.

Figure 8:
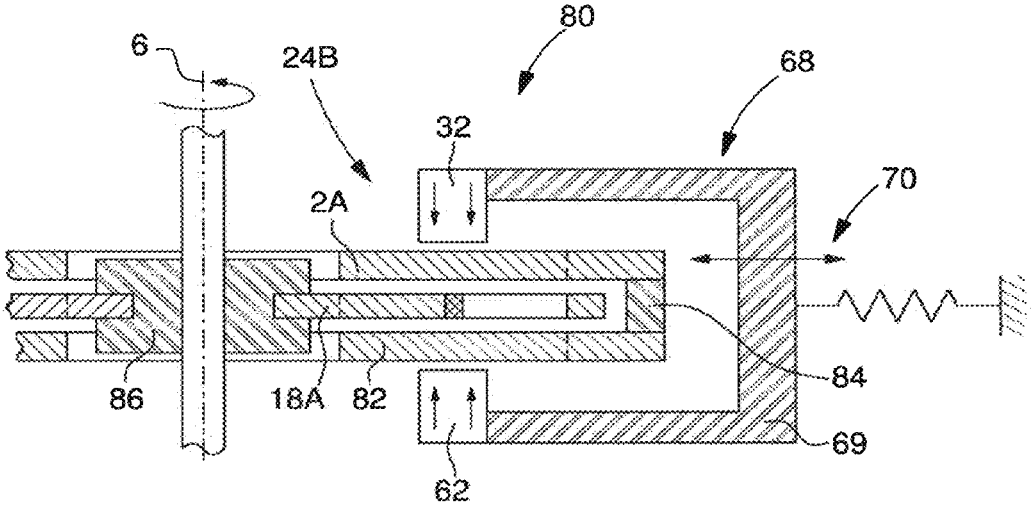
FIG. 8 shows schematically, in section, a third embodiment of the first regulating device according to the invention.

A third embodiment of a regulating device 80 of the first type is represented in FIG. 8. The elements in common with the embodiment of FIG. 5 will not be described again in detail. The regulating device comprises a resonator 70 and a magnetic escapement 24B formed by a first magnetic structure 2A, defining a first circular network similar to the network 3 of FIG. 2, and by a second magnetic structure 18A defining two concentric circular networks corresponding to the networks 19 and 20 of FIG. 2. It will be noted that, in the present case, these are the two concentric circular networks which form the escapement wheel and which rotate about the axis 6, the structure 2A being mounted fixed in the clock movement. This third embodiment is distinguished essentially from the preceding one in that it comprises a third magnetic structure 82 defining a fourth circular network which extends, like the first network, into an annular surface comprising the second and third phase-shifted networks of the structure 18A. This third structure is integral with the first structure 2A, the fourth circular network being identical to the first circular network and their magnetic lines are superimposed axially (no angular offset between the two networks). The first and fourth networks being respectively situated on both sides of the magnetic structure 18A forming the second and third networks.

The magnetic structure 18A comprises a central annular part which is continuous. Between the second and third networks, an annular intermediate part is provided, which is continuous, preferably made of magnetic material. Furthermore, a continuous annular peripheral part is likewise provided. The three continuous annular parts make it possible to have a magnetic structure 18A in a single piece with the magnetic lines of the two networks fixed to the two ends. In order that the continuous annular zones do not disturb operation of the magnetic escapement, it is provided that the circular networks extend over a radial length substantially greater than that of the oscillating magnets. This structure 18A is caught in a non-magnetic hub 86 mounted on the shaft of the escapement wheel. The two fixed structures 2A and 82 comprise respectively two continuous annular peripheral parts which are connected by a non-magnetic strut 84. This embodiment solves a problem which remains in the second embodiment. In fact, the two superimposed magnetic structures are attracted one towards the other because of the magnetic flux of the magnets. Thanks to the superimposition of the three magnetic structures, these attraction forces are cancelled out for the most part if the magnetic intermediate structure is situated substantially in the middle of the two others. It will be noted that various variants are conceivable. In a first variant, the two concentric phase-shifted networks are provided in the first and third magnetic structures whilst the second magnetic structure forms a single extended circular network. In another variant, it is provided that the first and third exterior structures are mounted on the shaft of the escapement wheel and are integral in rotation whilst the second intermediate structure is mounted in a fixed manner in the clock movement.

Figure 9:
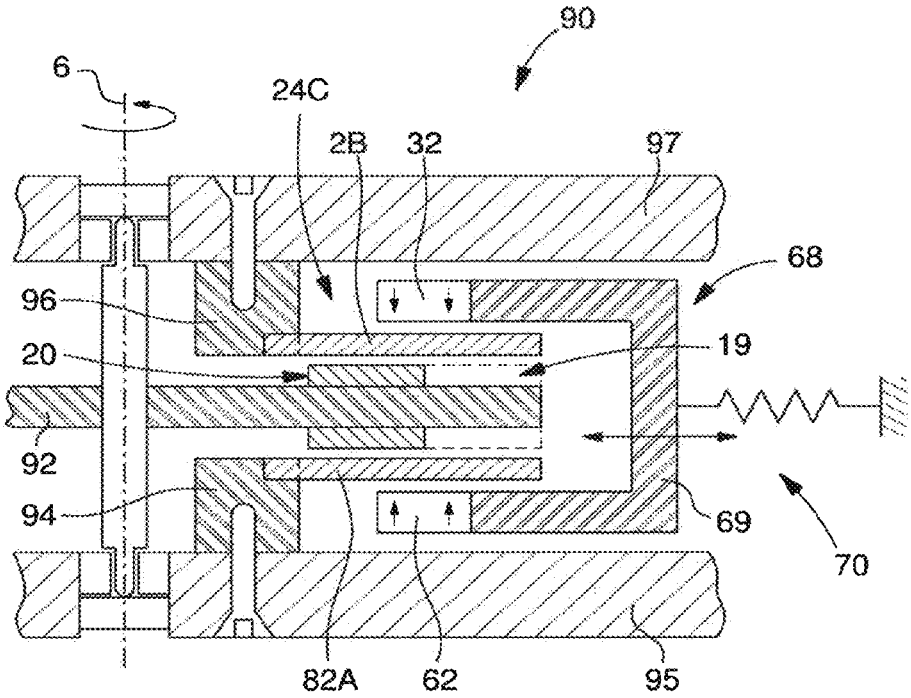
FIG. 9 represents schematically an embodiment variant of the regulating device of FIG. 8.

An embodiment variant will be described rapidly with the help of FIG. 9. This regulating device 90 is distinguished by the fact that the magnetic escapement 24C comprises two magnetic structures 2B and 82A, situated on both sides of an escapement wheel, which are connected to the clock movement by two non-magnetic supports 94 and 96, fixed and central respectively in two bridges 95 and 97, and by the fact that the two intermediate circular networks 19 and 20 are doubled and designed on both sides of a non-magnetic disc 92 forming the escapement wheel.

A first embodiment of a second device for regulating operation of a clock movement will be described with the help of FIG. 10. The regulating device 100 comprises a magnetic escapement 12, as described with the help of FIG. 1, with the sole difference that the superimposed circular networks have more magnetic lines and therefore a lesser angular period. However, as in FIG. 1, the difference in the magnetic lines $|\Delta N|$ is equal to one ($|\Delta N|=1$). An escapement wheel (not represented entirely) carries one of the two magnetic structures forming the combined pattern 14 and rotates about the central axis 6 of the circular networks defined by these two magnetic structures. The regulating device comprises in addition a resonator 102, a resonant part of which comprises a magnet 104. This resonator has two degrees of freedom with a resonance mode in which the magnet 104 substantially follows a circular trajectory with an angular resonance frequency, without turning on itself. To this end, this resonator is designed such that, when the centre of the magnet is moved away from the axis of rotation 6, its resonant part is subject to a radial return force relative to the axis of rotation 6, this return force being preferably angularly isotropic and radially linear in order that the regulating device is isochronous. Thus, the resonator is designed such that the centre of the magnet 104 substantially follows a circular trajectory, centred on the axis of rotation, with an angular resonance frequency $F_{res}$ when it is moved away from this axis of rotation and such that this magnet is set in rotation with a substantially constant torque. It will be noted that the trajectory can also be elliptical in this system without destroying the isochronism. In this latter case, it will be ensured that the magnet remains at least in part superimposed on the combined pattern which is formed by the superimposed circular magnetic networks. Such a resonator is represented schematically in FIG. 10 by a magnet 104 connected to two springs 106 and 108 which are orthogonal and which have substantially the same coefficient of elasticity, these two springs being mounted respectively on the supports 110 and 112 which slide without friction respectively in two orthogonal rails 114 and 116; which is illustrated schematically by carriages with wheels which theoretically have no inertia. The vectorial sum of the radial forces of the springs generates a return force (centripetal force) allowing the inertial part of the resonator to follow a substantially circular or elliptical trajectory.

Then, the annular region of the first and second magnetic structures, defining the combined pattern 14 with a first zone 15 having a large proportion of magnetic surface and a second zone 16 having a lesser proportion of magnetic surface, is coupled magnetically to the magnet 104 such that this magnet is set in rotation by a magnetic interaction torque resulting from the combined pattern rotating at the angular frequency $\omega$. The combined pattern rotates when a driving torque, within a useful range of the driving torque, is provided to the escapement wheel, the angular frequency of the combined pattern w being controlled at the angular resonance frequency $F_{res}$ in this useful range of the torque, the latter being selected such that the above-mentioned magnetic interaction torque remains less than a maximum magnetic interaction torque and such that said circle described by said centre of the magnet has a radius in the radial range of the combined pattern 14 for any driving torque of this useful range. The magnetic interaction in this resonator has the effect of synchronising the angular frequency $\omega$ of the escapement wheel at the resonance frequency $F_{res}$ of the resonator. The combined pattern 14 causes a variation in potential energy $E_{pot}$ in the resonator, as a function of the relative angular position of the magnet and of this combined pattern, between a minimum energy when the magnet is above the first zone 15 and a maximum energy when it is above the second zone 16. The angular gradient of this potential energy causes a tangential entrainment force on the magnet. In order to avoid a loss of synchronisation, it will be ensured that the braking torque exerted by the magnet on the escapement wheel remains less than the magnetic maximum interaction torque depending upon the maximum value of the gradient of the potential energy $E_{pot}$.

In a preferred variant, the resonator is designed and the useful range of the driving torque selected such that the magnet 104 is entirely superimposed on the combined pattern 14 for any driving torque of this useful range.

Figure 10:
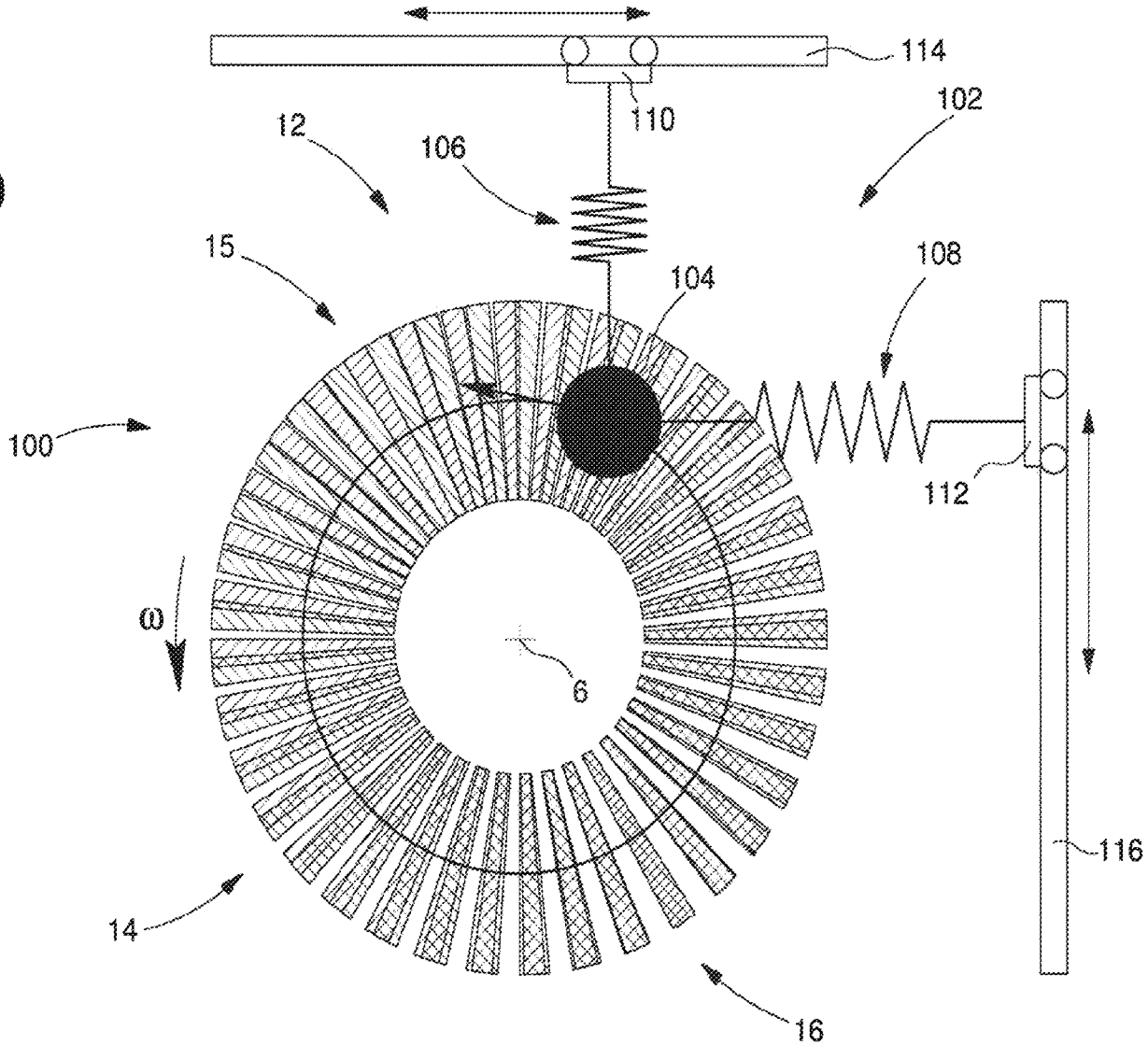
FIG. 10 represents schematically, in plan view, a first embodiment of a second regulating device according to the invention.
Figure 11:
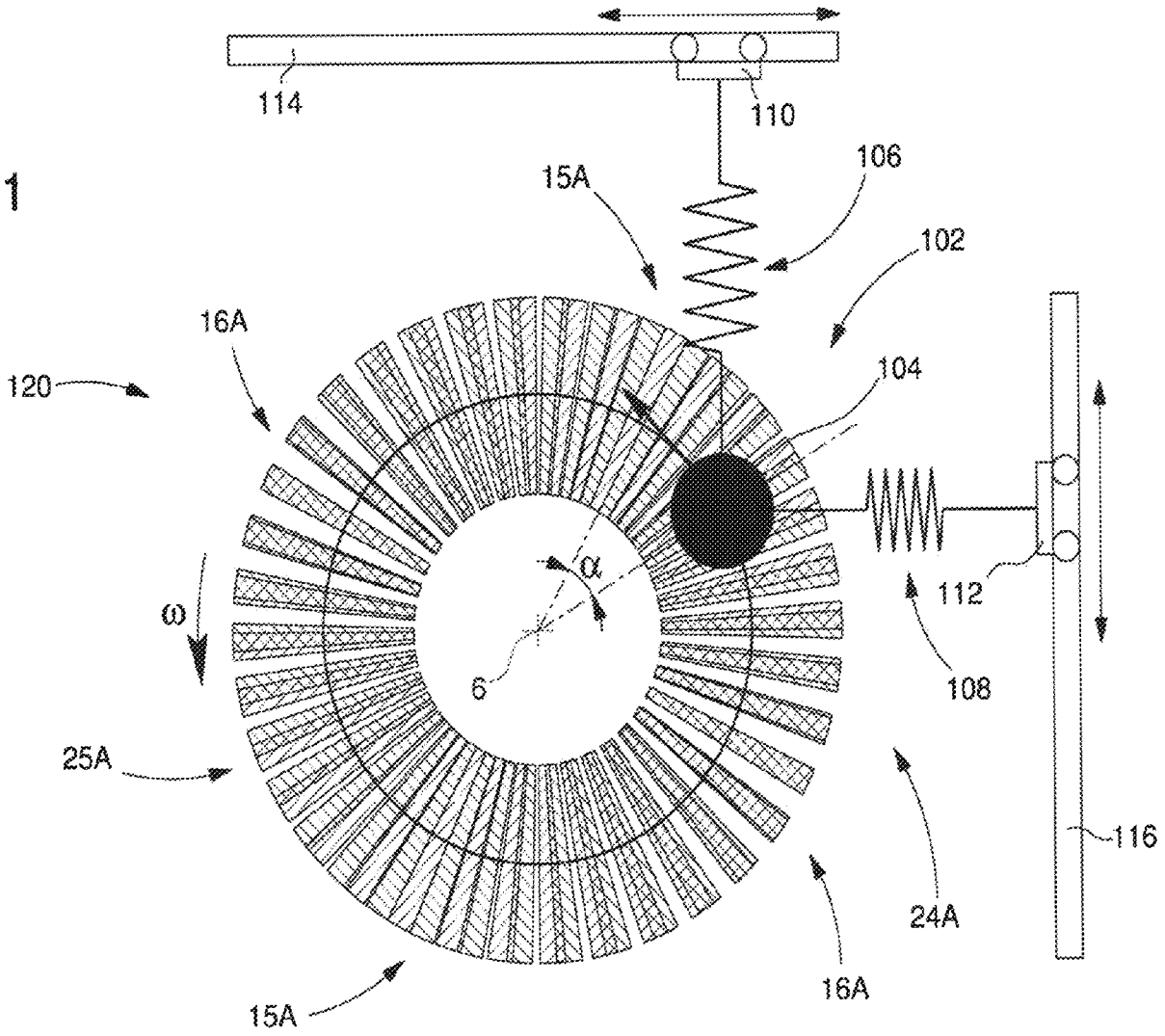
FIG. 11 represents schematically an embodiment variant of the regulating device of FIG. 10.

FIG. 11 shows an embodiment variant of the regulating device of FIG. 10. The elements already described above will not be done so again. This variant is distinguished from the preceding one by the fact that the magnetic escapement 24A is formed by two superimposed circular networks, with a difference in absolute value $|\Delta N|$ between their numbers of respective magnetic lines equal to two, i.e. $|\Delta N|=2$, similarly to the embodiment of one of the two combined patterns of FIG. 2. Thus, the combined pattern 25A has, alternately, two zones 15A having a large proportion of magnetic surface and two zones 16A having a lesser proportion of magnetic surface. Given that the magnetic potential energy difference between the extreme values is substantially equal to that of the preceding variant, but that this difference has an effect over an angular range half as small, the maximum force of magnetic interaction is substantially twice as great. In contrast, the ratio between the angular frequency of the combined pattern 25A and the frequency of rotation of the escapement wheel carrying one of the two circular magnetic networks is equal to half of the ratio of the preceding variant. Thus, the useful range of the driving torque is increased but the multiplication ratio between the frequency of the escapement wheel and the resonance frequency is reduced. It will be noticed that the magnet 104 has an angular offset a less than 90° and in particular less than 45°, this angular offset varying as a function of the torque resulting from the magnetic interaction between the magnet 104 and the combined pattern 25A.

Figure 12:
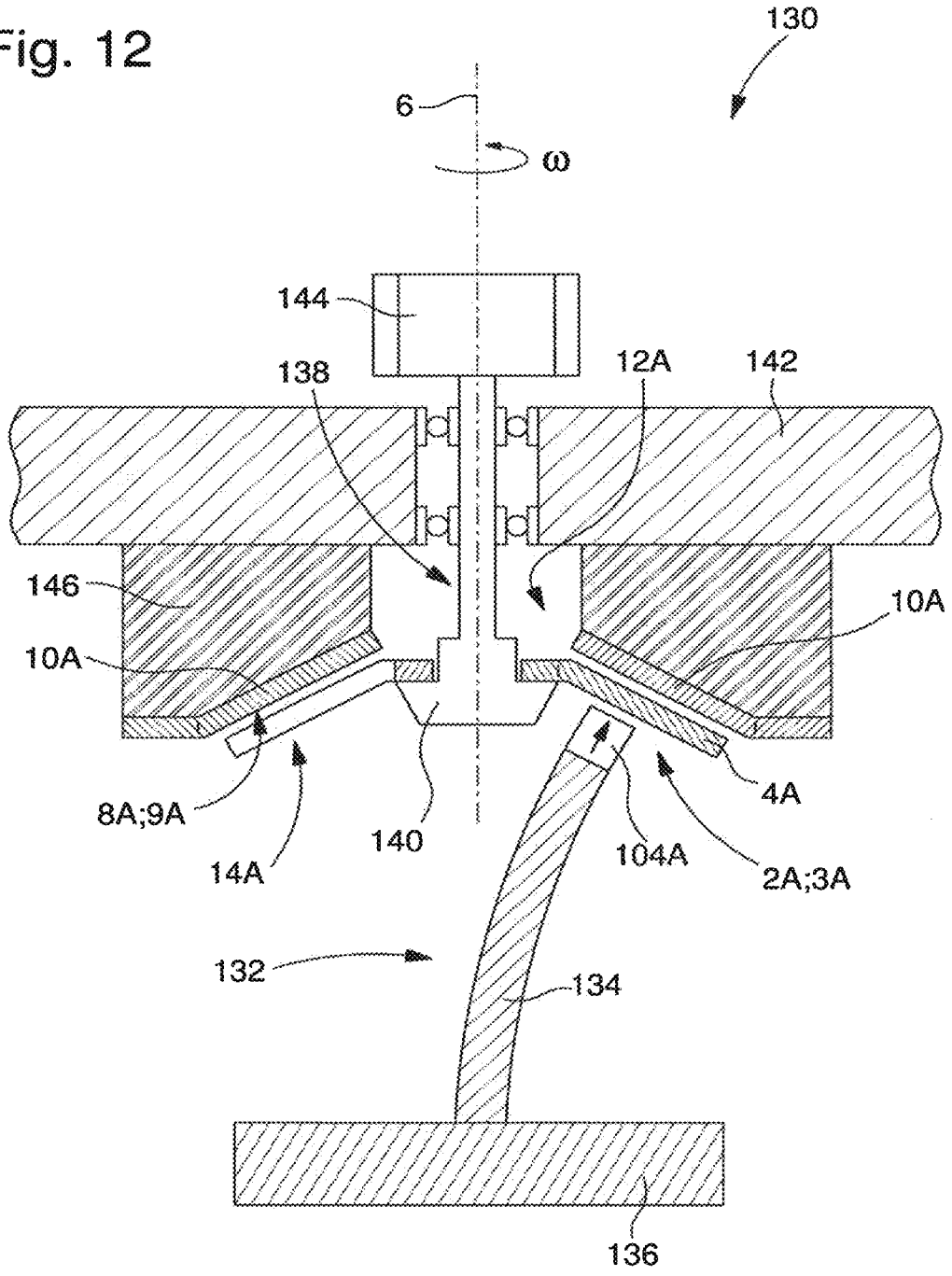
FIG. 12 represents schematically, in section, a second embodiment of the second regulating device according to the invention.

FIG. 12 represents schematically a second embodiment of the second regulating device according to the invention. This regulating device 130 is a particular embodiment implementing the physical characteristics mentioned in the preceding description of the first embodiment. The resonator 132 is formed by a bar 134 elastically deformable according to two degrees of freedom, substantially defining a portion of a sphere, this bar being fixed in a socket 136. At its free end, this bar carries a magnet 104A. The magnetic escapement 12A is similar to that described for FIGS. 2 and 10. It comprises a first magnetic structure 2A, forming a first circular network 3A, the magnetic lines 4A of which extend into a first truncated surface, and a second magnetic structure 8A, forming a second circular network 9A, the magnetic lines 10A of which extend into a second truncated surface parallel to the first truncated surface. As already described, a combined pattern 14A similar to the combined pattern 14 mentioned above is obtained. The first magnetic structure 2A is mounted on a shaft 138 which is guided in rotation by two ball bearings provided in a bridge 142. The second magnetic structure is fixed and provided on a non-magnetic support 146. The structure 2A comprises a continuous interior annular part which connects the magnetic lines 4A and the structure 8A comprises a continuous exterior annular part which connects the magnetic lines 10A. At one end of the shaft 138, a truncated part 140 is provided, forming a central circular limit stop for the magnet 104A, this limit stop being designed so that at least the major part of this magnet remains superimposed on the combined pattern 14A when no driving torque is provided to the escapement wheel formed here by the first magnetic structure 2A, the shaft 138 and a pinion 144. This pinion is connected to a counting mechanism of a mechanical clock movement through which it receives a driving torque provided by a motor device (not represented).

Finally, in general, the invention relates to a mechanical clock movement comprising a regulating device, a counting mechanism paced by this regulating device and a motor device for driving the counting mechanism and maintaining a resonance mode of the regulating device. This clock movement is characterised by the fact that it comprises a magnetic escapement according to the invention or a regulating device according to the invention.

The invention claimed is:

1. A magnetic escapement equipping a mechanical clock movement and comprising:

an escapement wheel driven by a motor device and coupled to a resonator of the mechanical clock movement, the escapement wheel comprising a first magnetic structure defining, within a non-zero radial range of the escapement wheel, a first periodic pattern with a first angular period P1 such that 360°/P1 is equal to a first whole number N1;

at least one magnet mounted on the resonator and coupled magnetically to the escapement wheel such that, when the mechanical clock movement functions, the magnet has a periodic resonance movement at a resonance frequency and such that the escapement wheel rotates with a frequency proportional to the resonance frequency;

a second magnetic structure parallel to the first magnetic structure and defining, within the radial range, a second periodic pattern having a second angular period P2 such that 360°/P2 is equal to a second whole number N2 which is different from the whole number N1, the difference in absolute value |ΔN| between the numbers N1 and N2 being a number less than or equal to N/2, |ΔN|<=N/2, N being the lower number of the numbers N1 and N2;

wherein the first and second magnetic structures are configured such that, when the clock movement functions, the first magnetic structure has a rotation relative to the second magnetic structure at a first relative angular frequency $F1_{rel}$; and wherein the first periodic pattern and the second periodic pattern are selected such that they generate, within the radial range, in projection on a geometric surface parallel to the first and second magnetic structures, a combined pattern coupled to the magnet and which defines, alternately, at least the number |ΔN| of first zone(s) with a first proportion of magnetic surface and at least the number |ΔN| of second zone(s) with a second proportion of magnetic surface less than the first proportion, and such that the combined pattern rotates relative to the second magnetic structure with a second relative angular frequency $F2_{rel}$ equal to the first relative angular frequency $F1_{rel}$ multiplied by the number N1 and divided by the difference ΔN between the numbers N1 and N2, $F2_{rel}=F1_{rel}\cdot N1/\Delta N$ where ΔN=N1−N2.

2. The magnetic escapement according to claim 1, wherein the magnet has a magnetization axis perpendicular to the geometric surface of the combined pattern.

3. The magnetic escapement according to claim 1, wherein the combined pattern defines a periodic combined pattern having, alternately, the number |ΔN| of first zone(s) and the number |ΔN| of second zone(s), any first zone and an adjacent second zone defining an angular period P3 of the periodic combined pattern, the value of which is equal to 360° divided by the number |ΔN|, P3=360°/|ΔN|.

4. The magnetic escapement according to claim 3, wherein the first pattern forms a first circular network with lines made of magnetic material separated by lines defined by an empty space or a substantially non-magnetic material, and the second pattern forms a second circular network with lines made of magnetic material separated by lines defined by an empty space or a substantially non-magnetic material.

5. The magnetic escapement according to claim 4, wherein the lines made of magnetic material of the first circular network extend substantially over half of the first angular period P1 and the lines made of magnetic material of the second circular network extend substantially over half of the second angular period P2.

6. A regulating device for regulating operation of a clock movement comprising:

the magnetic escapement according to claim 4;

a resonator, one resonant part of which supporting the magnet is subject, during functioning of the clock movement, to an oscillation according to one degree of freedom;

wherein the resonator is configured such that the center of the magnet in its rest position is substantially situated, for any angular position of the escapement wheel, on a zero position circle which is centered on the axis of rotation of the escapement wheel and which is traversed by the degree of freedom of the resonant part of the resonator; and wherein the periodic combined pattern is situated on a first side of the zero position circle, projected perpendicularly in the geometric surface, the annular region of the first and second magnetic structures, defined by the radial range, being coupled magnetically to the magnet in a first alternation of each period of the oscillation such that, for each period of the oscillation, the periodic combined pattern rotates by an angular distance equal to its angular period P3.

7. The regulating device according to claim 6, the periodic combined pattern being a first periodic combined pattern and the radial range being a first radial range;

wherein the first and second magnetic structures define respectively, within a second non-zero radial range of the escapement wheel situated on an other side of the zero position circle, relative to the first radial range, a third periodic pattern and a fourth periodic pattern which generate a second periodic combined pattern, having, alternately, the number |ΔN| of third zone(s), with a third proportion of magnetic surface greater than the second proportion, and the number |ΔN| of fourth zone(s), with a fourth proportion of magnetic surface which is less than the first and third proportions, the second periodic combined pattern having the angular period P3; and wherein the second periodic combined pattern is offset angularly by half an angular period P3 relative to the first periodic combined pattern, the second periodic combined pattern rotating likewise with the second relative angular frequency $F2_{rel}$, the annular region of the first and second magnetic structures, defined by the second radial range, being coupled magnetically to the magnet in a second alternation of each period of the oscillation.

8. The regulating device according to claim 7, wherein the third periodic pattern forms a third circular network with lines made of magnetic material, separated by lines defined by an empty space or a substantially non-magnetic material, and the fourth periodic pattern forms a fourth circular network with lines made of magnetic material, separated by lines defined by an empty space or a substantially non-magnetic material, the third and fourth circular networks having an angular period respectively equal to the first and second angular periods P1 and P2.

9. The regulating device according to claim 8, wherein the first and second periodic combined patterns are substantially contiguous; and wherein the first and third circular networks or the second and fourth circular networks together form a same circular network which extends at least over the first and second radial ranges.

10. The regulating device according to claim 7, wherein the resonator includes a tuning fork with two branches, the magnet forming a first magnet fixed to the free end of a first branch, the resonator further includes a second magnet fixed to the free end of the second branch; and wherein the number |ΔN| is an even number.

11. The regulating device according to claim 10, wherein the number |ΔN| is equal to 2, |ΔN|=2.

12. The regulating device according to claim 6, the magnet being a first magnet;

wherein the magnetic escapement comprises a second magnet mounted on the resonator and supported by the resonant part or by another resonant part of the resonator, the second magnet configured relative to the first magnet on an other side of the first and second magnetic structures to be aligned with the first magnet in a direction substantially parallel to the axis of rotation and to have a periodic resonance movement similar to that of the first magnet at the resonance frequency.

13. The regulating device according to claim 12, wherein the second magnet has a magnetization axis parallel to that of the first magnet and in an opposite direction.

14. The regulating device according to claim 12, wherein the second magnet has a magnetization axis parallel to that of the first magnet and in a same direction.

15. The regulating device according to claim 12, wherein the magnetic escapement comprises a third magnetic structure defining a periodic pattern substantially identical to the periodic pattern defined by the first or second magnetic structure and superimposed on the second magnetic structure, the third periodic structure being integral in rotation with the first or second magnetic structure, in a case the second magnetic structure is subject to a rotation, the two magnetic structures having a same periodic pattern being situated respectively on both sides of the magnetic structure having a different periodic pattern.

16. The mechanical clock movement comprising:

a regulating device;

a counting mechanism paced by the regulating device; and a motor device driving the counting mechanism and maintaining a resonance mode of the regulating device;

wherein the regulating device is a regulating device according to claim 12.

17. The regulating device according to claim 6 for regulating operation of a clock movement, wherein the second magnetic structure is fixed relative to the clock movement, the first relative angular frequency $F1_{rel}$ defining the angular frequency of the escapement wheel relative to the clock movement.

18. A mechanical clock movement comprising:

a regulating device;

a counting mechanism paced by the regulating device; and a motor device driving the counting mechanism and maintaining a resonance mode of the regulating device, wherein the regulating device is a regulating device according to claim 6.

19. A device for regulating operation of a clock movement comprising:

a magnetic escapement according to claim 1;

a resonator having a resonant part supporting the magnet, the resonator being configured such that the resonant part is subject to a radial return force relative to the axis of rotation of the escapement wheel when the center of the magnet is moved away from the axis of rotation, and such that the center of the magnet substantially follows a circular or elliptical trajectory centered on the axis of rotation, at an angular resonance frequency when it is moved away from the axis of rotation, and such that the magnet is set in rotation with a substantially constant torque; and wherein the annular region of the first and second magnetic structures, defined by the radial range, is coupled magnetically to the magnet such that the magnet is set in rotation by a magnetic interaction torque resulting from the combined pattern rotating when a driving torque, within a useful range of the driving torque, is provided to the escapement wheel, the angular frequency of the combined pattern being controlled at the angular resonance frequency within the useful range of the torque, which is selected such that the magnetic interaction torque remains lower than a maximum magnetic interaction torque and such that the trajectory of the center of the magnet has a radius within the radial range for any driving torque of the useful range.

20. The regulating device according to claim 19, wherein the resonator is configured and the useful range of the driving torque is selected such that the magnet is entirely superimposed on the combined pattern for any driving torque of the useful range.

21. The regulating device according to claim 20, further comprising a central circular limit stop for the magnet, the limit stop configured so that at least the major part of the magnet remains superimposed on the combined pattern when no driving torque is provided to the escapement wheel.

22. The regulating device according to claim 19, wherein the number $|\Delta N|$ is equal to one or two, $|\Delta N|=1$ or $|\Delta N|=2$.

23. The regulating device according to claim 19, the magnet being a first magnet;

wherein the magnetic escapement comprises a second magnet mounted on the resonator and supported by the resonant part or by another resonant part of the resonator, the second magnet configured relative to the first magnet on an other side of the first and second magnetic structures to be aligned with the first magnet in a direction substantially parallel to the axis of rotation and to have a periodic resonance movement similar to that of the first magnet at the resonance frequency.

24. The regulating device according to claim 23, wherein the second magnet has a magnetization axis parallel to that of the first magnet and in an opposite direction.

25. The regulating device according to claim 23, wherein the second magnet has a magnetization axis parallel to that of the first magnet and in a same direction.

26. The regulating device according to claim 23, wherein the magnetic escapement comprises a third magnetic structure defining a periodic pattern substantially identical to the periodic pattern defined by the first or second magnetic structure and superimposed on the second magnetic structure, the third periodic structure being integral in rotation with the first or second magnetic structure, in a case the second magnetic structure is subject to a rotation, the two magnetic structures having a same periodic pattern being situated respectively on both sides of the magnetic structure having a different periodic pattern.

27. The mechanical clock movement comprising:

a regulating device;

a counting mechanism paced by the regulating device; and a motor device driving the counting mechanism and maintaining a resonance mode of the regulating device;

wherein the regulating device is a regulating device according to claim 23.

28. The regulating device according to claim 19 for regulating operation of a clock movement, wherein the second magnetic structure is fixed relative to the clock movement, the first relative angular frequency $F1_{rel}$ defining the angular frequency of the escapement wheel relative to the clock movement.

29. The mechanical clock movement comprising:

a regulating device;

a counting mechanism paced by the regulating device; and a motor device driving the counting mechanism and maintaining a resonance mode of the regulating device, wherein the regulating device is a regulating device according to claim 19.

30. A mechanical clock movement comprising:

a regulating device;

a counting mechanism paced by the regulating device; and a motor device driving the counting mechanism and maintaining a resonance mode of the regulating device;

wherein the regulating device comprises a magnetic escapement according to claim 1.

* * * * *